United States Patent [19]

Urbanek

[11] 4,118,767

[45] Oct. 3, 1978

[54] MARKER LAMP LENS AND MOUNTING THEREFOR

[75] Inventor: Karel Urbanek, Weston, Canada

[73] Assignee: Dominion Auto Accessories Limited, Toronto, Calif.X

[21] Appl. No.: 724,522

[22] Filed: Sep. 20, 1976

[51] Int. Cl.[2] ..... F21V 17/00

[52] U.S. Cl. ..... 362/455; 339/93 L; 362/267

[58] Field of Search ..... 240/7.1, 8.2, 41 L, 240/90, 151, 152, 153, 52 R; 339/93 R, 93 C, 93 L, 126 R; 362/267, 369, 455, 456, 457

[56] References Cited

U.S. PATENT DOCUMENTS

| | | | |
|---|---|---|---|
| 2,694,798 | 11/1954 | Cole | 240/153 X |
| 2,707,747 | 5/1955 | DeFrees | 240/152 X |
| 2,712,120 | 6/1955 | Cochran | 240/52 R X |
| 3,096,026 | 7/1963 | Bruce et al. | 240/151 X |
| 3,387,255 | 6/1968 | Earleywine | 240/152 X |
| 3,887,803 | 6/1975 | Savage | 240/151 |

*Primary Examiner*—Fred L. Braun

*Attorney, Agent, or Firm*—Barnes, Kiessell, Raisch & Choate

[57] ABSTRACT

A marker lamp comprising a housing and a lens. The housing has an opening into which the lens extends. An O-ring is positioned in a circumferentially extending groove in the opening of the housing. The lens has a cylindrical portion that extends into the opening which has a cylindrical surface that is engaged by the O-ring. The cylindrical surface has a length in a direction of the axis thereof greater than the width of the groove in the housing. The lens also has circumferentially spaced axially extending projections on a portion of the lens that extends axially beyond the groove.

4 Claims, 10 Drawing Figures

MARKER LAMP LENS AND MOUNTING THEREFOR

This invention relates to marker lamps and particularly lamps that are adapted to be mounted on the roof or cab of an automotive vehicle.

BACKGROUND OF THE INVENTION

In automotive vehicles such as trucks, it is common to utilize a marker lamp to delineate the outline or configuration of portions thereof such as the cab. In one well known type of such lamp shown in U.S. Pat. No. 3,096,026, a housing is angularly adjustably mounted upon a base and supports a lamp in a shock mount.

One of the main disadvantages recognized in constructions such as that set forth in U.S. Pat. No. 3,096,026 arises from the complexity of assembly. The use of such a construction virtually precludes the application of any automated assembly procedures. As a consequence, the cost becomes prohibitive for applications where high volume requirements are present.

Among the objects of the invention are to provide an improved marker lamp which has a simple, effective shock absorbing mounting; which is easily assembled; and which will withstand severe usage without damage.

SUMMARY OF THE INVENTION

In accordance with the invention, the shock mounting member extending through the opening of the spring retainer has spaced annular flanges extending along opposite sides of said retainer. One of the flanges has circumferentially spaced integral protuberances extending axially and engaging one surface of the retainer for holding the opposite surface of the retainer against the opposite flange. The shock mounting member has an axially extending opening therein and a spacer having an axial opening therein is positioned and engages the opening in the shock mounting member. The spacer having an inwardly turned flange along one end thereof. A socket retainer having a planar surface engages the inwardly turned flange of said spacer and the end of the shock mounting member. The socket retainer has portions thereof crimped into engagement with the periphery of said shock mounting member. A socket member has an end with a reduced diameter extending through the opening defined by the inwardly turned flange of said spacer and the opening in the socket retainer. The reduced end is crimped outwardly into engagement with the opposite surface of the flange on the spacer.

DESCRIPTION

Figure 1:
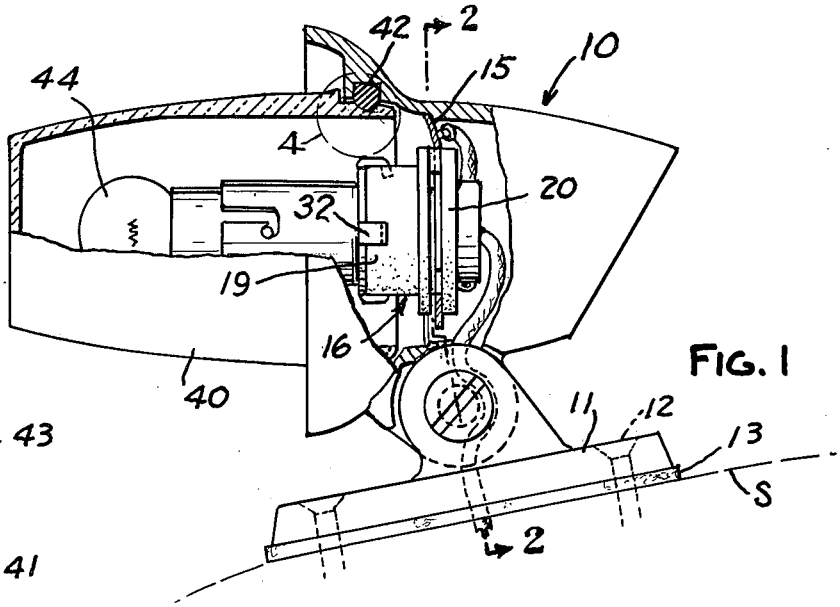
FIG. 1 is a part sectional elevational view of a marker lamp embodying the invention.

Referring to FIG. 1, the marker lamp comprises a hollow housing 10 which is angularly adjustably mounted on a base 11 that is, in turn, fixed to the surface of the automotive vehicle S by screws 12 extending through the base and a resilient pad 13.

The interior of the housing is hollow and a flat spring retainer 14 has three equally spaced radially projecting portions 15 engaging the interior surface. The spring retainer 14 has an opening 17 having a notch 17*a*. A shock mounting member 16 of resilient material, such as rubber, is mounted through the opening 17 in the spring retainer 14 and comprises a cylindrical body 18 having spaced flanges 19, 20 at one end defining a groove 21 which receives the spring retainer 14. Flange 19 includes four axially extending cylindrical protuberances 22 having flat ends that engage one surface of the spring retainer to urge it against the side of groove 21. Although integral protuberances 22 are preferred, the axial positioning of spring retainer 14 with respect to shock mounting member 16 can also be achieved by forming an annular axially extending U-shaped rib on spring retainer 14 which engages one side of groove 21 to hold spring retainer 14 against the other side of groove 21.

The base 23 of the groove 21 has four outwardly extending radial projections 24 which are spaced equally apart circumferentially and are arcuate and engage the opening 17 of spring retainer 14 to frictionally hold the shock mounting member 16 against circumferential movement as well as to suspend spring retainer 14.

Figure 5:
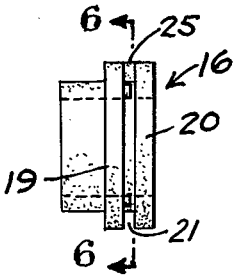
FIG. 5 is a side elevational view of the shock mounting member utilized in the lamp.
Figure 6:
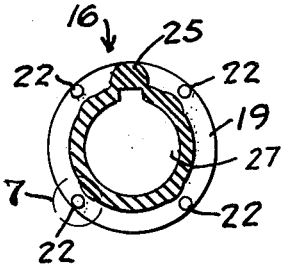
FIG. 6 is a sectional view taken along the line 6—6 in FIG. 5.
Figure 2:
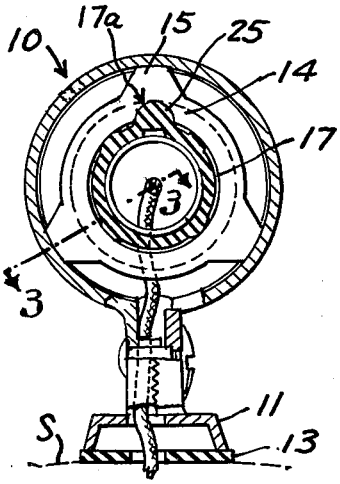
FIG. 2 is a sectional view taken along the line 2—2 in FIG. 1.
Figure 7:
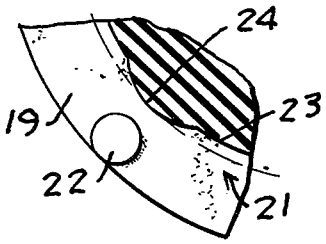
FIG. 7 is an enlarged sectional view of the circle 7 in FIG. 6.

The shock mounting member also includes a portion 25 that is integral and extends between the flanges 19, 20 to provide rigidity thereto. Portion 25 extends into notch 17*a* in opening 17 of spring retainer 14 to hold shock mounting member 16 against circumferential movement. (FIG. 5).

A spacer 26 which is generally cylindrical and made of metal is press fitted into opening 27 in the shock mounting member 16 and has a radially inwardly turned flange 28. A socket retainer 29 made of metal includes an annular portion 30 that engages the outer surface 31 of flange 28. Retainer 29 is held in position by crimping spaced fingers or portions 32 along the outer surface of the body 18 and inwardly into the body.

Figure 3:
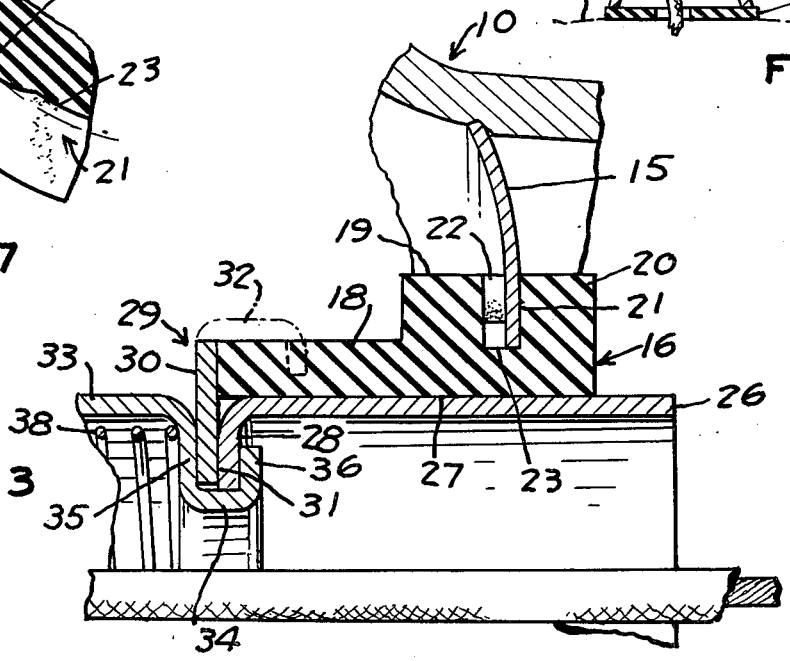
FIG. 3 is a fragmentary sectional view on an enlarged scale taken along the line 3—3 in FIG. 2.

A socket 33 which is generally cylindrical has a portion 34 of reduced diameter extending through the opening in the portion 30 of retainer 29 with an interconnecting portion 35 engaging the outer surface of retainer 29. The free end 36 of the socket is crimped outwardly against the other surface of flange 28 of spacer 26 (FIG. 3).

In this manner, the socket 33 is resiliently mounted in the housing 10 firmly and such that it will provide long life for the bulb 44. The socket has a spring 38 and associated pigtail wiring assembly in accordance with conventional construction.

Figure 4:
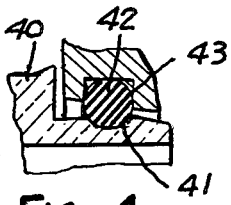
FIG. 4 is a view of the portion in the circle 4 in FIG. 1 on an enlarged scale.
Figure 8:
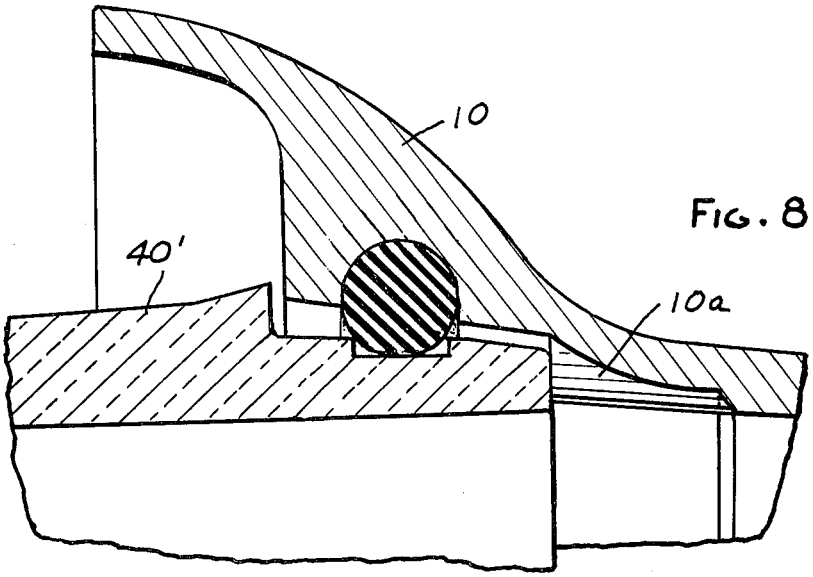
FIG. 8 is a part sectional view similar to FIG. 4 on an enlarged scale.

A lens 40 having a semi-circular groove 41 at one end extends inwardly of the housing so that an O-ring 42 in a rectangular opening 43 in the housing 10 engages the groove 41 to hold the lens 40 in position. Groove 41 has an axial width greater than the diameter of O-ring 42 (FIGS. 4, 8). When lens 40 is in position on housing 10, the end of the lens 40 engages circumferentially spaced bosses 10*a* on housing 10.

The construction of the marker lamp is thus such that it is adaptable to automated assembly procedures.

Figure 9:
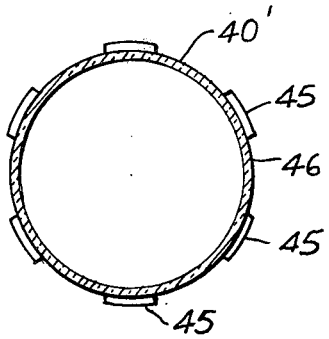
FIG. 9 is a sectional view taken along the line 9—9 in FIG. 10.
Figure 10:
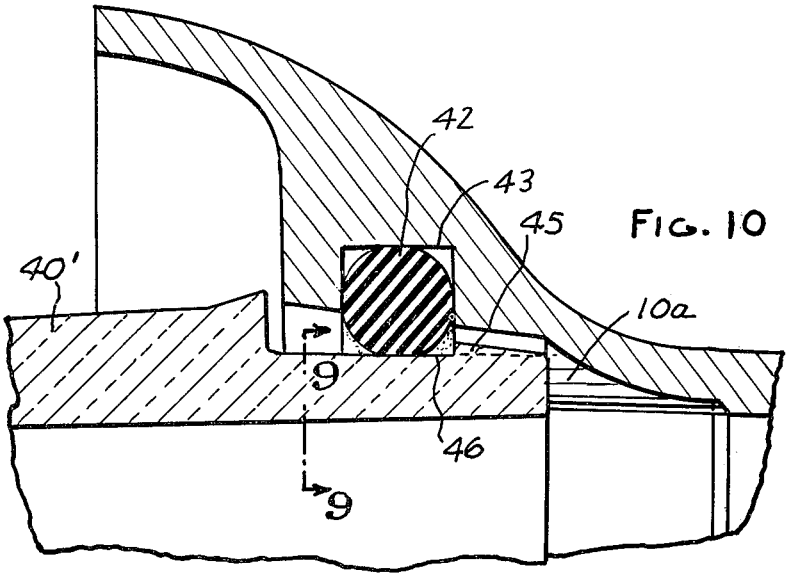
FIG. 10 is a part sectional view similar to FIG. 8 of a modified form of the invention.

In the modified construction shown in FIGS. 9 and 10, the lens 40' does not have a groove but instead has circumferentially spaced retaining projections 45 on the outer cylindrical surface 46 thereof. O-ring 42 is positioned in rectangular groove 43 of housing 10 and engages surface 46 to hold the lens 40' in position. The outer surfaces of projections 45 are inclined inwardly toward the free end thereof to provide ramps that facilitate insertion of lens 40' in housing 10. Projections 45 function to prevent the lens from being pulled out inadvertently only but are not normally engaged by the O-ring. The space between adjacent projections 45 is greater than the circumferential extent of projections 45 so that the total circumferential extent of projections 45 is less than the total circumferential extent of the spaces between projections 45.

The width of the cylindrical surface 46 axially inwardly of the projections 45 is greater than the width of the groove 43.

I claim:

1. In a marker lamp, a lens, a housing having an opening into which said lens extends, said housing having a circumferentially extending groove in the opening thereof, a resilient sealing ring in said groove, said lens having an outer cylindrical surface extending into said opening, said sealing ring engaging said cylindrical surface, said cylindrical surface having a length in the direction of the axis thereof which is greater than the width of said groove, said cylindrical surface having circumferentially spaced radially extending projections thereon on a portion of said lens extending axially within the opening of said housing beyond said groove.

2. The combination set forth in claim 1 wherein the outer surfaces of said projections are inclined inwardly toward the free end and they provide ramps that facilitate insertion of the lens in the housing when the sealing ring is in said groove.

3. The combination set forth in claim 1 wherein the space between the adjacent projections is greater than the circumferential extent of the projections.

4. The combination set forth in claim 1 wherein said sealing ring comprises an O-ring.

* * * * *

UNITED STATES PATENT AND TRADEMARK OFFICE

CERTIFICATE OF CORRECTION

PATENT NO. : 4,118,767

DATED : October 3, 1978

INVENTOR(S) : Karel Urbanek

It is certified that error appears in the above-identified patent and that said Letters Patent are hereby corrected as shown below:

Correct the assignee's address from "Toronto, Calif.X"

to --Toronto, Canada--

Signed and Sealed this

*Sixth* Day of *February 1979*

[SEAL]

*Attest:*

RUTH C. MASON
*Attesting Officer*

DONALD W. BANNER
*Commissioner of Patents and Trademarks*